US011536290B2

(12) United States Patent
Li et al.

(10) Patent No.: US 11,536,290 B2
(45) Date of Patent: Dec. 27, 2022

(54) FAN COIL UNIT AND AIR CONDITIONING SYSTEM

(71) Applicant: CARRIER CORPORATION, Palm Beach Gardens, FL (US)

(72) Inventors: Huanan Li, Shanghai (CN); Chang Luo, Shanghai (CN); Shuguang Zhang, Shanghai (CN); Jin Liu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 29 days.

(21) Appl. No.: 17/125,102

(22) Filed: Dec. 17, 2020

(65) Prior Publication Data

US 2021/0317843 A1 Oct. 14, 2021

(30) Foreign Application Priority Data

Apr. 8, 2020 (CN) ..... 202010268469.9

(51) Int. Cl.

| | |
|---|---|
| ***F04D 29/58*** | (2006.01) |
| ***F04D 29/26*** | (2006.01) |
| ***F24F 7/007*** | (2006.01) |
| ***F04D 29/40*** | (2006.01) |
| ***F04D 17/04*** | (2006.01) |

(52) U.S. Cl.

CPC ..... *F04D 29/582* (2013.01); *F04D 17/04* (2013.01); *F04D 29/26* (2013.01); *F04D 29/403* (2013.01); *F04D 29/5826* (2013.01); *F24F 7/007* (2013.01); *F05D 2260/213* (2013.01)

(58) Field of Classification Search

CPC ..... F04D 17/04; F04D 29/26; F04D 29/281; F04D 29/403; F04D 29/5826; F05D 2260/213

See application file for complete search history.

(56) References Cited

U.S. PATENT DOCUMENTS

| | | | | |
|---|---|---|---|---|
| 3,200,609 | A * | 8/1965 | Laing | F24F 1/031 165/122 |
| 3,250,457 | A * | 5/1966 | Walker | F04D 17/04 D23/370 |
| 5,570,996 | A * | 11/1996 | Smiley, III | F04D 29/441 415/206 |
| 5,943,878 | A * | 8/1999 | Smiley, III | F24F 7/007 415/53.3 |
| 6,071,070 | A * | 6/2000 | Yamamoto | B60H 1/00471 62/244 |
| 6,086,324 | A * | 7/2000 | Ikeda | F04D 17/04 415/119 |
| 2013/0259669 | A1* | 10/2013 | Tadokoro | F04D 29/30 415/185 |
| 2020/0300498 | A1* | 9/2020 | Lopatinsky | F04D 17/04 |

* cited by examiner

*Primary Examiner* — Courtney D Heinle
*Assistant Examiner* — Danielle M. Christensen
(74) *Attorney, Agent, or Firm* — Cantor Colburn LLP

(57) ABSTRACT

The present disclosure provides a fan coil unit and an air conditioning system. The fan coil unit includes: a housing, which defines an airflow inlet, an airflow outlet, and an airflow path from the airflow inlet to the airflow outlet; a cross-flow fan, which is located at the airflow inlet to introduce an airflow into the housing; and a heat exchange unit located downstream of the cross-low fan on the airflow path.

7 Claims, 1 Drawing Sheet

FAN COIL UNIT AND AIR CONDITIONING SYSTEM

CROSS-REFERENCE TO RELATED APPLICATIONS

This application claims the benefit of Chinese Application No. 202010268469.9 filed Apr. 8, 2020, the disclosure of which is incorporated herein by reference in its entirety.

BACKGROUND

The present disclosure relates to the technical field of air conditioning, and more specifically, the present disclosure relates to an improved fan coil unit and an air conditioning system having the fan coil unit.

Air conditioning systems used in shopping malls or buildings are often air conditioning systems with fan coil unit arranged in various areas to regulate air in these areas. A centrifugal fan is typically used in the existing fan coil units. Due to the limitation of an outlet space of the centrifugal fan, airflows on the coils are unevenly distributed, and the structure is relatively complicated.

BRIEF DESCRIPTION

An object of the present disclosure is to solve or at least alleviate the problems existing in the prior art.

According to an aspect, a fan coil unit is provided, which includes:

a housing, which defines an airflow inlet, an airflow outlet, and an airflow path from the airflow inlet to the airflow outlet;

a cross-flow fan, which is located at the airflow inlet to introduce an airflow into the housing; and a heat exchange unit located downstream of the cross-low fan on the airflow path.

Optionally, in an embodiment of the fan coil unit, the airflow inlet faces downward, and the airflow outlet and the airflow inlet are oriented to be perpendicular to each other.

Optionally, in an embodiment of the fan coil unit, the housing at the airflow inlet includes a pair of side walls, an upper volute and a lower volute, an impeller of the cross-flow fan is arranged laterally between the pair of side walls, a drive motor of the cross-flow fan is located outside one of the pair of side walls, and the impeller is surrounded by the upper volute and the lower volute.

Optionally, in an embodiment of the fan coil unit:

the upper volute includes a diverging portion extending upward from a front side of the impeller along a divergent line contour, for example extending in a substantially vertical upward direction to the divergent line contour, and then extending along the divergent line contour into a substantially horizontal direction; and/or the lower volute includes an inclined portion extending obliquely in a backward and downward direction from a rear side of the impeller.

Optionally, in an embodiment of the fan coil unit, the lower volute further includes an enclosing plate surrounding a part of the impeller; for example, the enclosing plate corresponds to a central angle of 10 to 40 degrees of the impeller; optionally, the enclosing plate corresponds to a central angle of 20 to 30 degrees of the impeller.

Optionally, in an embodiment of the fan coil unit, the upper volute further includes a small baffle connected to a bottom of the diverging portion.

Optionally, in an embodiment of the fan coil unit, the heat exchange unit is a tube-fin heat exchanger, which spans the entire airflow path and is obliquely arranged in the airflow path in face of the (forward and downward) direction of the airflow.

Optionally, in an embodiment of the fan coil unit, an inclination angle of the inclined portion of the lower volute is smaller than an inclination angle of the heat exchange unit; optionally, the inclination angle of the inclined portion of the lower volute is in a range of 20 to 70 degrees, e.g., in a range of 30 to 60 degrees, e.g., in a range of 40 to 50 degrees, and the inclination angle of the heat exchange unit is in a range of 30 to 80 degrees, e.g., in a range of 45 to 75 degrees, e.g., in a range of 55 to 65 degrees.

Optionally, in an embodiment of the fan coil unit, the central angle of the impeller corresponding to the airflow inlet is between 120 degrees and 240 degrees, e.g., between 160 degrees and 200 degrees, e.g., between 170 and 190 degrees.

In another aspect, an air conditioning system is provided, which includes the fan coil unit as described in various embodiments.

BRIEF DESCRIPTION OF THE DRAWINGS

With reference to the accompanying drawings, the disclosure of the present disclosure will become easier to understand. It can be easily understood by those skilled in the art that these drawings are only for illustrative purpose, and are not intended to limit the scope of protection of the present disclosure. In addition, similar numbers in the drawings are used to denote similar components, in which.

DETAILED DESCRIPTION

Figure 1:
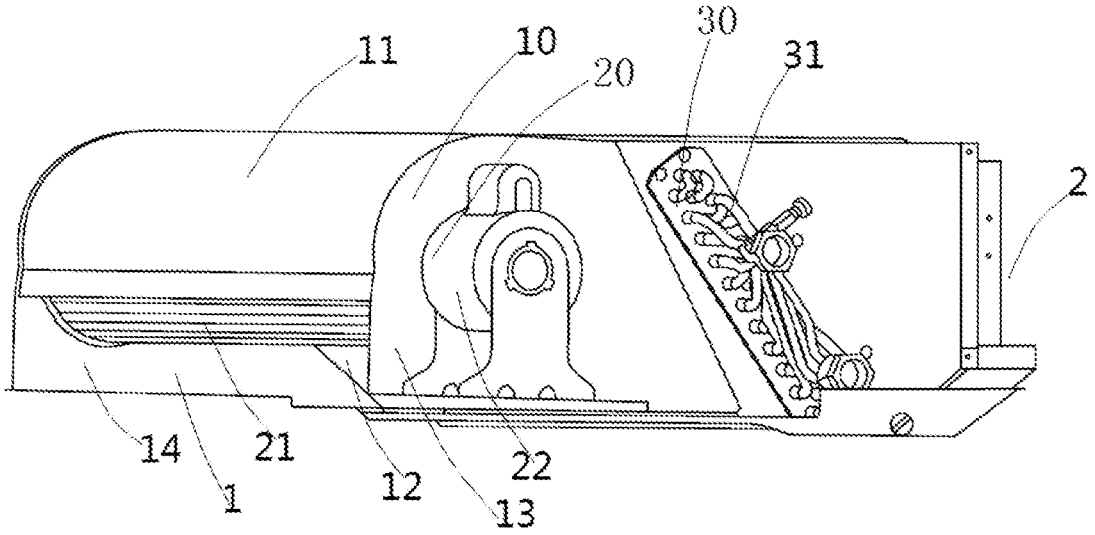
FIG. 1 shows a perspective view of a fan coil unit according to an embodiment of the present disclosure.

It can be easily understood that according to the technical solutions of the present disclosure, without changing the true spirit of the present disclosure, those skilled in the art can propose a variety of mutually replaceable structural modes and implementations. Therefore, the following specific embodiments and the accompanying drawings are merely exemplary illustrations of the technical solutions of the present disclosure, and should not be regarded as the entirety of the present disclosure or as definitions or limitations to the technical solutions of the present disclosure.

The orientational terms that have been mentioned or might be mentioned in this specification, such as "upper", "lower", "left", "right", "front", "rear", "front side", "back side", "top", "bottom", etc., are defined relative to the configurations shown in the drawings. They are relative concepts, so they may change accordingly according to their different locations and different states of use. Therefore, these or other orientational terms should not be interpreted as restrictive terms.

Figure 2:
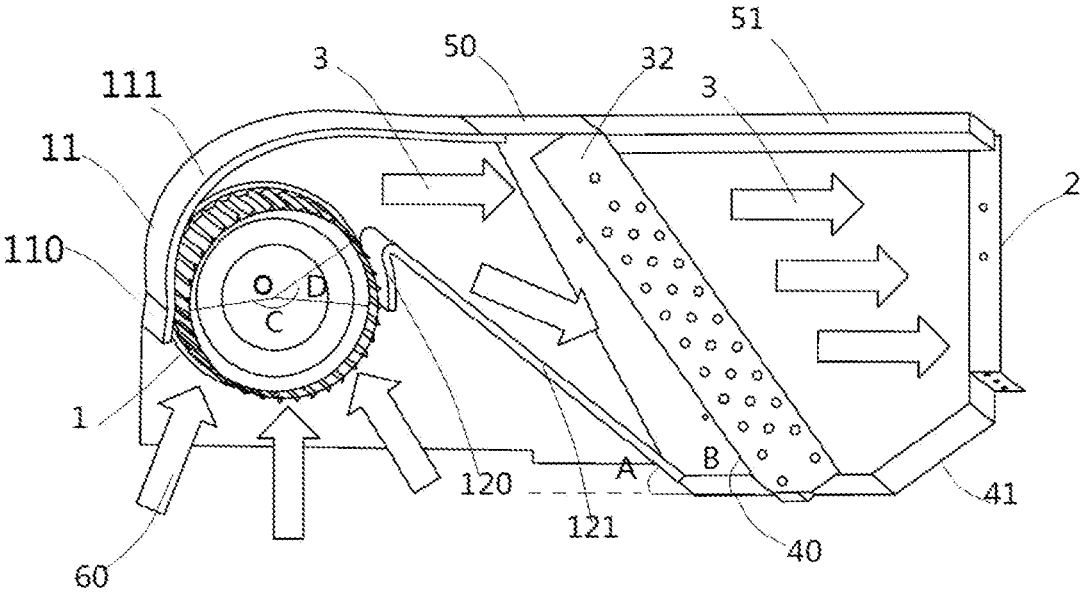
FIG. 2 shows an internal structure view of the fan coil unit according to the embodiment of the present disclosure.

With reference to FIGS. 1 and 2, the fan coil unit according to the embodiment of the present disclosure will be explained. The fan coil unit includes: a housing 10 that defines an airflow inlet 1, an airflow outlet 2, and an airflow path 3 from the airflow inlet 1 to the airflow outlet 2; a cross-flow fan 20, which is located at the airflow inlet 1 to introduce an airflow into the housing 10; and a heat exchange unit 30 in the housing 10, which is located downstream of the cross-flow fan 20 on the airflow path 3.

The fan coil unit according to the embodiment of the present disclosure uses a cross-flow fan arranged at the airflow inlet to replace a traditional centrifugal fan. The airflow path is shown by arrows in FIG. 2.

In some embodiments, the airflow inlet 1 substantially faces downward, and the airflow outlet 2 is substantially horizontal and may be perpendicular to the airflow inlet. The airflow path 3 extends between the airflow inlet 1 and the airflow outlet 2, and when air passes through the airflow path, it contacts a cooling medium in coils 31 at the heat exchange unit 30, thereby adjusting the indoor air. In an alternative embodiment, the airflow inlet 1 and the airflow outlet 2 may have other orientations and layouts.

In the illustrated embodiment, the housing 10 at the airflow inlet 1 includes a pair of side walls 13, 14 opposite to each other, an upper volute 11 and a lower volute 12. The cross-flow fan 20 includes an impeller 21 and a fan motor 22. The fan motor 22 drives the impeller 21 to rotate (for example, rotate in the clockwise direction in the figure) to drive air from the airflow inlet 1 into the fan coil unit, as shown by arrows marked 60 in FIG. 2. In the illustrated embodiment, the impeller 21 is arranged laterally between the pair of side walls 13, 14 and substantially spans the entire width between the pair of side walls. The drive motor 22 of the cross-flow fan may be located outside one of the pair of side walls, such as outside the side wall 13 in the figure. In some embodiments, for example, the entire fan coil unit may be trisected into an upper part, a middle part and a lower part in the height with horizontal lines. The circular center O of the impeller 21 may be located in the middle part, and the entire impeller may span the upper part, the middle part and the lower part. The side walls may extend over the upper, middle and lower parts of the entire fan coil in the height, the upper volute may be located in the upper and middle parts, and the lower volute may be located in the upper, middle and lower parts, or located in the middle and lower parts. Although not shown, the underside of the fan impeller can be shielded by a screen plate.

In some embodiments, the upper volute 11 includes a diverging portion 111 that extends upward from a rear side of the impeller 21 along a divergent line contour. For example, from a position closest to the impeller 21, the diverging portion 111 extends in a vertical upward direction along a divergent line into a substantially horizontal direction. The divergent line means that: on the divergent line, the distance from a point to the circular center O of the fan impeller gradually increases as the point becomes further downstream. In some embodiments, the diverging portion 111 of the upper volute extends from a position that is substantially on the same horizontal plane as the circular center O of the impeller with a certain distance to the impeller. In some embodiments, the upper volute 11 further includes a small baffle 110 which is located under and connected to the diverging portion 111. The small baffle 110 can be slightly inclined to the outside of the fan coil unit to guide the incoming airflow 60 and eliminate the influence of airflows in other directions on the impeller (such as an airflow coming from the left side in the figure in a direction opposite to the rotation direction of the impeller), thereby improving the efficiency of the fan coil unit.

In some embodiments, the lower volute 12 includes an inclined portion 121 extending obliquely in a backward and downward direction from the rear side of the impeller. In some embodiments, an included angle A between the inclined portion 121 of the lower volute 12 and the horizontal plane may be in a range of 20 to 70 degrees; optionally, the included angle A may be in a range of 30 to 60 degrees; optionally, the included angle A may be in a range of 40 to 50 degrees. In some embodiments, the lower volute 12 further includes an enclosing plate 120 surrounding a part of the impeller 21, and the enclosing plate 120 may extend downwardly around the impeller from one end of the inclined portion 121. In some embodiments, the enclosing plate 120 may correspond to a central angle D of 10 to 40 degrees of the impeller 21 so as to surround the impeller. Optionally, the enclosing plate 120 may, for example, correspond to a central angle D in a range of 20 to 30 degrees.

In the embodiment shown in the drawings, the heat exchange unit 30 may be a tube-fin heat exchanger well known in the art, which includes a heat exchange unit body 32, and a supply pipeline 31 located outside the side wall 13. The supply pipeline supplies a cooling medium to the heat exchange unit body 32 for heat exchange with the passing airflow. In some embodiments, the heat exchange unit 30 may be arranged in the airflow path in a backward and downward inclined manner, thereby improving the stability of the heat exchange unit 30. For example, it may span the entire section. In some embodiments, in order to optimize the contact between the fluid and the heat exchange unit 30, the heat exchange unit 30 may form an included angle B with the horizontal direction, wherein the included angle B is larger than an included angle A between the inclined portion 121 of the lower volute and the horizontal direction. In some embodiments, the included angle B between the heat exchange unit 30 and the horizontal direction may be in a range of 30 to 80 degrees, e.g., in a range of 45 to 75 degrees, and optionally in a range of 55 to 65 degrees. Through the inclined arrangement of the heat exchange unit, on one hand, the contact area between the airflow and the heat exchange unit can be increased, and on the other hand, it can be ensured that the heat exchange unit is stably arranged in the airflow path. In addition, such an arrangement can make the fluid more uniform, and in the event of the same size of the heat exchange unit, the thickness of the fan coil unit is made thinner, which is more convenient for indoor installation. As shown in the drawings, the upper volute 11 may be connected with a horizontal transition plate 50 and a plate 51 before arriving at the fluid outlet 2, and the lower volute 121 may be connected with a horizontal plate 40 which may include a water accumulator to receive condensation water. In addition, an inclined plate 41 may be provided, which can reduce the height of the air outlet 2 to meet the size requirements on the air outlet 2 while ensuring a sufficient height in the airflow path 3.

In some embodiments, the upper volute 11 and the lower volute 12 together define the size of the air inlet 1. In some embodiments, the airinlet defined by the upper volute 11 and the lower volute 12 corresponds to a central angle C of the fan impeller that is in a range of 120 degrees to 240 degrees, e.g., in a range of 160 degrees to 200 degrees, e.g., in a range of 170 degrees to 190 degrees, such as around 180 degrees.

In another aspect, an air conditioning system is provided, which includes the fan coil unit as described in various embodiments.

The advantages of the fan coil unit according to the embodiment of the present disclosure include, but are not limited to: easy realization of the downward airflow inlet and easy installation. The heat exchange unit and the cross-flow fan are arranged close to each other to increase the heat exchange area. The inclinedly arranged heat exchange unit has better stability and heat exchange area, which conforms to the aerodynamic design of the outlet airflow of the cross-flow fan. Some of these features realize a compact, fully heat-exchanged fan coil unit, including uniform airflow distribution and competitive cost advantage.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A fan coil unit, comprising:

a housing, which defines an airflow inlet, an airflow outlet, and an airflow path from the airflow inlet to the airflow outlet;

a cross-flow fan, which is located at the airflow inlet to introduce an airflow into the housing; and a heat exchange unit located downstream of the cross-low fan on the airflow path;

wherein the housing at the airflow inlet comprises a pair of side walls, an upper volute and a lower volute, an impeller of the cross-flow fan is arranged laterally between the pair of side walls, a drive motor of the cross-flow fan is located outside one of the pair of side walls, and the impeller is surrounded by the upper volute and the lower volute;

wherein the upper volute comprises a diverging portion extending upward from a front side of the impeller along a divergent line contour by extending from a substantially vertical upward direction to the divergent line contour, and then extending along the divergent line contour into a substantially horizontal direction;

wherein the lower volute comprises an inclined portion extending obliquely in a backward and downward direction from a rear side of the impeller;

wherein the lower volute further comprises an enclosing plate surrounding a part of the impeller.

2. The fan coil unit according to claim 1, wherein the airflow inlet faces downward, and the airflow outlet and the airflow inlet are oriented to be perpendicular to each other.

3. The fan coil unit according to claim 1, wherein the heat exchange unit is a tube-fin heat exchanger, which spans the entire airflow path and is obliquely arranged in the airflow path in face of the direction of the airflow.

4. The fan coil unit according to claim 3, wherein:

an inclination angle of the inclined portion of the lower volute with respect to the horizontal direction is smaller than an inclination angle of the heat exchange unit;

the inclination angle of the inclined portion of the lower volute is in a range of 20 to 70 degrees; and the inclination angle of the heat exchange unit is in a range of 30 to 80 degrees.

5. The fan coil unit according to claim 1, wherein the central angle of the impeller corresponding to the airflow inlet is between 120 degrees and 240 degrees.

6. An air conditioning system, comprising the fan coil unit according to claim 1.

7. A fan coil unit, comprising:

a housing, which defines an airflow inlet, an airflow outlet, and an airflow path from the airflow inlet to the airflow outlet;

a cross-flow fan, which is located at the airflow inlet to introduce an airflow into the housing; and a heat exchange unit located downstream of the cross-low fan on the airflow path;

wherein the housing at the airflow inlet comprises a pair of side walls, an upper volute and a lower volute, an impeller of the cross-flow fan is arranged laterally between the pair of side walls, a drive motor of the cross-flow fan is located outside one of the pair of side walls, and the impeller is surrounded by the upper volute and the lower volute;

wherein the upper volute comprises a diverging portion extending upward from a front side of the impeller along a divergent line contour by extending from a substantially vertical upward direction to the divergent line contour, and then extending along the divergent line contour into a substantially horizontal direction;

wherein the upper volute further comprises a small baffle connected to a bottom of the diverging portion.

* * * * *